US007218333B2

(12) United States Patent
Choi

(10) Patent No.: US 7,218,333 B2
(45) Date of Patent: May 15, 2007

(54) GRAY SCALE DISPLAY APPARATUS USING PULSE WIDTH MODULATION

(75) Inventor: Jeung-Hie Choi, Ichon-shi (KR)

(73) Assignee: Magnachip Semiconductor, Ltd. (KR)

( * ) Notice: Subject to any disclaimer, the term of this patent is extended or adjusted under 35 U.S.C. 154(b) by 672 days.

(21) Appl. No.: 10/750,068

(22) Filed: Dec. 30, 2003

(65) Prior Publication Data

US 2005/0017993 A1 Jan. 27, 2005

(30) Foreign Application Priority Data

Jul. 25, 2003 (KR) ..... 10-2003-0051427

(51) Int. Cl.
*G09G 5/10* (2006.01)

(52) U.S. Cl. ..... 345/691; 345/693; 345/89; 345/204

(58) Field of Classification Search ..... 345/691, 345/89, 204, 693
See application file for complete search history.

(56) References Cited

U.S. PATENT DOCUMENTS 6,927,785 B2 * 8/2005 Kobayashi ..... 345/691
7,113,195 B2 * 9/2006 Willis et al. ..... 345/691

* cited by examiner

*Primary Examiner*—Richard Hjerpe
*Assistant Examiner*—Leonid Shapiro
(74) *Attorney, Agent, or Firm*—Blakely Sokoloff Taylor & Zafman

(57) ABSTRACT

A multi-gradation display apparatus using a pulse width modulation (PWM) method. The display apparatus includes a plurality of channels; a plurality of input blocks for outputting a plurality of N-bit image code in response to a gray scale of an image, wherein N is a positive integer; a pulse width modulation generator for outputting first and second gray scale pulses, each having $2^N$ edges in response to the bit number of N-bit image code; and a plurality of count controllers, each selecting an edge of the first or second gray scale pulse in response to the N-bit image code to output a driving pulse having a pulse width from an initial point to the edge of the first or second gray scale pulse to the plurality of channels, wherein the second gray scale pulse is complementary with the first gray scale pulse.

6 Claims, 5 Drawing Sheets

GRAY SCALE DISPLAY APPARATUS USING PULSE WIDTH MODULATION

FIELD OF INVENTION

The present invention relates to a circuit for driving multi channels for use in a gray scale display apparatus; and, more particularly, to a pulse width modulation (PWM) selector in the circuit of the gray scale display apparatus using pulse width modulation (PWM).

DESCRIPTION OF PRIOR ART

In a liquid crystal display (hereinafter, referred to a LCD), which is generally used as a display device, each pixel basically includes a scanning electrode for controlling a scanning line included in the liquid crystal display and a data electrode for adjustably showing data on each pixel when each scanning line is selected. In addition, each pixel is coupled to each other in a matrix structure.

For driving a conventional LCD having the matrix structure, there is generally used a voltage averaging method employing a sequential scanning technique by multiplexing a pixel data. This method may be used without losing any contrast of an image if the LCD device is slowly operated, e.g., an operation speed of the LCD device is about 400 msec.

Meanwhile, in a display, which can reproduce a fast moving image or present a fast moving mouse point, like a super twisted nematic (hereinafter, referred as STN) LCD, a multi-line scanning (MLS) technique is generally used. A gray scale of an image in the STN LCD is adjusted by a pulse width modulation (PWM) method.

In addition, there is a frame rate control (FRC) method for adjusting the gray scale of the image. In the FRC method generally used as a kind of driving method for use in the LCD device, a frame has a plurality of sub-frames. The FRC method has an advantage of implementation cost. However, in the FRC method, the more the gray scale is segmented minutely, the more the frame should have sub-frames. As a result, the operation speed of the LCD device using the FRC method is decreased. Namely, the LCD device using the FRC method is not proper for reproducing the fast moving image.

FIG. 1 is a block diagram describing a conventional driver having a PWM selector using the PWM method for adjusting the gray scale of the image.

As shown, the PWM selector is coupled to a PWM signal generator 100 and a plurality of decoders 110_1 to 110_n. The PWM signal generator 100 generates 16 gray scale pulses, wherein each of the 16 gray scale pulses has a different pulse width from each other. Each of the plurality of decoders 110_1 to 110_n receives a 4-bit data code, e.g., $DIN_1$<3:0>. Each decoder converts an inputted 4-bit data code into a 16-bit scale code. The PWM selector outputs a selected gray scale pulse among the 16 gray scale pulses in response to the 16-bit scale code outputted from each decoder, e.g., 110_1. In addition, a buffer 130 is used for delivering the 16 gray scale pulses to the PWM selector.

There are N number of channels CH1 to CHn. Herein, N is a positive integer. Each channel, e.g, CH1 is coupled to 16 number of selecting units 120*a* to 120*p* included in the PWM selector. Each channel is driven by a gray scale pulse selected by the 16-bit gray scale. Each channel is corresponding to each pixel column of panel in the LCD device.

Herein, the PWM selector is used in the case that an image data code is 4-bit; however, the PWM selector can be modified in response to the bit number of the image data code.

FIG. 2 is waveforms describing the plurality of gray scale pulses and an operation of the PWM selector shown in FIG. 1.

As illustrated, there are 16 gray scale pulses P<0> to P<15> each having a different pulse width. If a first image data code $DIN_1$ is "0011," the PWM selector outputs a third gray scale pulse P<2> matched with "0011" to a first channel CH1. Likewise, if a $(n-1)^{th}$ image data code $DIN_{(n-1)}$ is "0110," the PWM selector outputs a sixth gray scale pulse P<5> and, if a $n^{th}$ image data code $DIN_n$ is "1111," the PWM selector outputs a $16^{th}$ gray scale pulse P<15>, where n is the number of channels.

As described above, in the PWM method for adjusting the gray scale of the image, there should be the number of PWM gray scale pulses in response to the bit number of the image data code. Namely, the number of PWM gray scale pulses is $2_N$ if the bit number of the image data code is N. For example, if the image data code is 4-bit, the number of PWM gray scale pulses is $2^4$ and, if the image data code is 12-bit, the number of PWM gray scale pulses is $2^{12}$.

FIG. 3 is a block diagram depicting a conventional RGB interface applied with a PWM selector using the PWM method.

As shown, the PWM selector for outputting each color gray scale code to each channel is coupled to a plurality of decoders 310_1 to 310_n and three PWM generators 300*a* to 300*c*, where n is the number of channels. In the conventional RGB interface, each channel, e.g., CH1 is constituted with three color sub-channels, e.g, R<1>, G<1> and B<1>. Also, each decoder, e.g., 310_1 includes three sub-decoders 310_1A, 310_1B and 310_1C. Each sub-decoder, e.g., 310_1A serves as each 4-bit color data, e.g., RI<1> of an image data, e.g., DATA1. Three PWM generators 300*a* to 300*c* respectively generate three color gray scale pulses PR<0:15>, PG<0:15> and PB<0:15>, wherein each color gray scale pulse, e.g., PR<0:15> includes 16 gray scale pulses PR<0> to PR<15> each having a different pulse width in response to the 4-bit color data, e.g., RI<1> of the image data, e.g., DATA1. Each color gray scale pulse is transmitted through each buffer, e.g., 330*a*.

Herein, each channel also corresponds to each pixel column in the LCD device. Each channel, e.g., CH1 includes three color sub-channels, R<1>, G<1> and B<1>. In addition, each color data of the image data is 4-bit.

Hereinafter, an operation of the PWM selector is described in detail. The decoder, e.g., 310_1 converts each 4-bit color data of the image data code into each 16-bit color scale code. In response to each 16-bit color scale code outputted from each decoder, the PWM selector outputs a selected gray scale pulse among the 16 gray scale pulses of each color gray scale pulse to each channel.

As described above, in the PWM method for adjusting the gray scale of the image, there should be the number of PWM gray scale pulses in response to the bit number of the image data code, e.g., there should be 16 PWM gray scale pulses if the bit number of the image data code is 4. In addition, if each channel has three color sub-channels R, G and B, the number of PWM gray scale pulses is increased three times. As a result, in case the bit number of the image data code is N and each channel has K color sub-channels, there should be $K \times 2^N$ number of PWM gray scale pulses.

Therefore, the higher quality image is reproduced, i.e., the more bits of the image data code is needed, the more wires are needed for transmitting a plurality of PWM gray scale pulses in response to the bit number of the image data code. In addition, it is difficult to integrate an apparatus using the PWM method, and current consumption is greatly increased due to a large number of wires.

SUMMARY OF INVENTION

It is, therefore, an object of the present invention to provide a multi-gradation display apparatus using pulse width modulation (PWM) which can enhance integration of the same and reduce current consumption by preventing an increase in the number of PWM gray scale pulses corresponding to an increase in the bit number of an image data code.

In accordance with an aspect of the present invention, there is provided a multi-gradation display apparatus using a pulse width modulation (PWM) method including a plurality of channels; a plurality of input blocks for outputting a plurality of N-bit image code in response to a gray scale of an image, wherein N is a positive integer; a pulse width modulation generator for outputting first and second gray scale pulses, each having $2_N$ edges in response to the bit number of N-bit image code; and a plurality of count controllers, each selecting an edge of the first or second gray scale pulse in response to the N-bit image code to output a driving pulse having a pulse width from an initial point to the edge of the first or second gray scale pulse to the plurality of channels, wherein the second gray scale pulse is complementary with the first gray scale pulse.

In accordance with another aspect of the present invention, there is provided a plurality of channels; a plurality of input means for outputting a plurality of N-bit image code in response to a gray scale of an image, wherein N is a positive integer; a pulse width modulation generator for outputting a gray scale pulse having $2_N$ edges in response to the bit number of N-bit image code; and a plurality of count controllers, each selecting an edge of the gray scale pulse in response to the N-bit image code to output a driving pulse having a pulse width from an initial point to the edge of the first or second gray scale pulse to the plurality of channels.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF INVENTION

Hereinafter, a multi-gradation display apparatus using a pulse width modulation (hereinafter, referred as a PWM) method will be described in detail with reference to the accompanying drawings.

Figure 1:
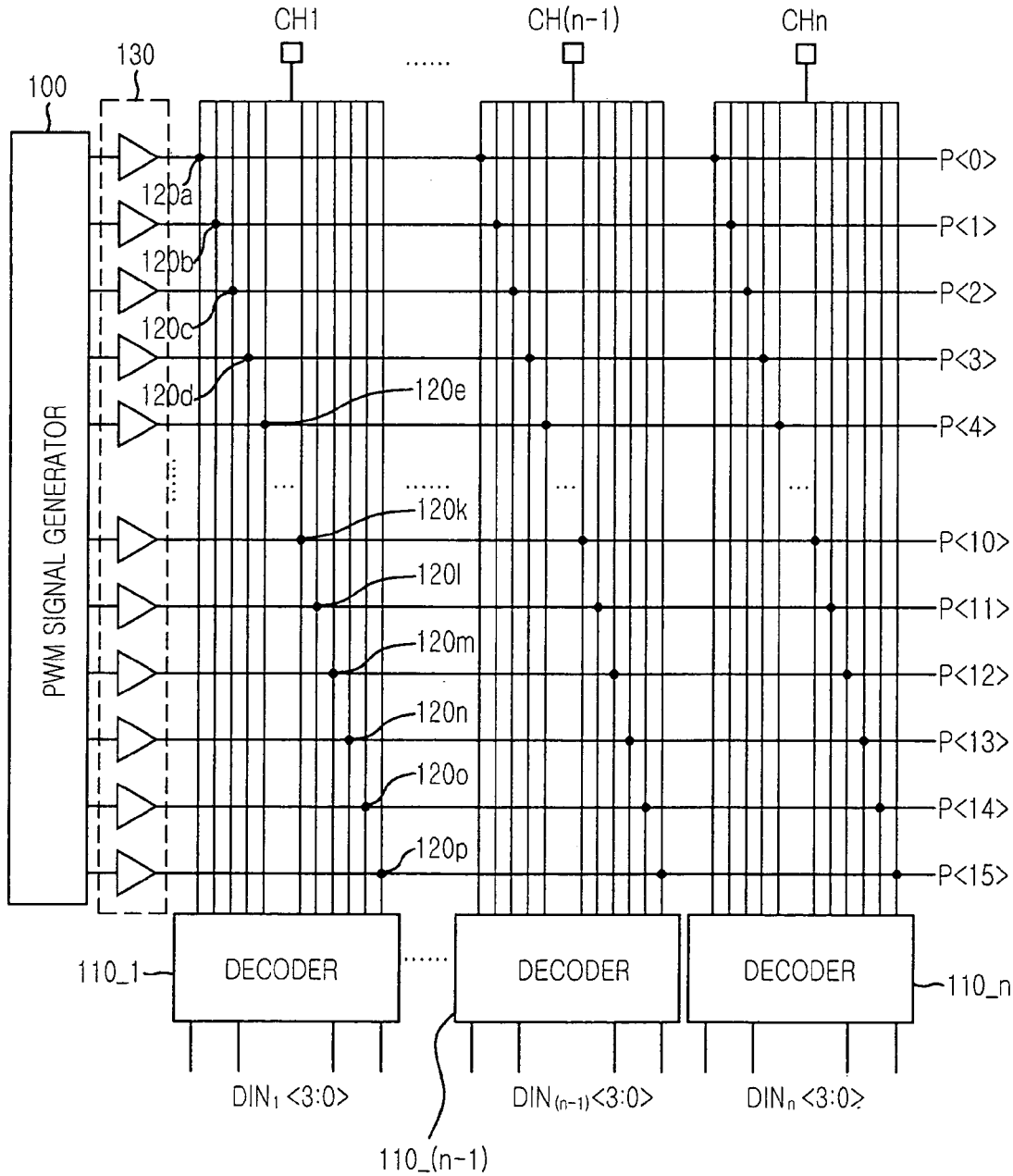
FIG. 1 (PRIOR ART)
FIG. 1 is a block diagram describing a conventional pulse width modulation (hereinafter, referred as a PWM) selector using the PWM method for adjusting the gray scale of the image.
Figure 2:
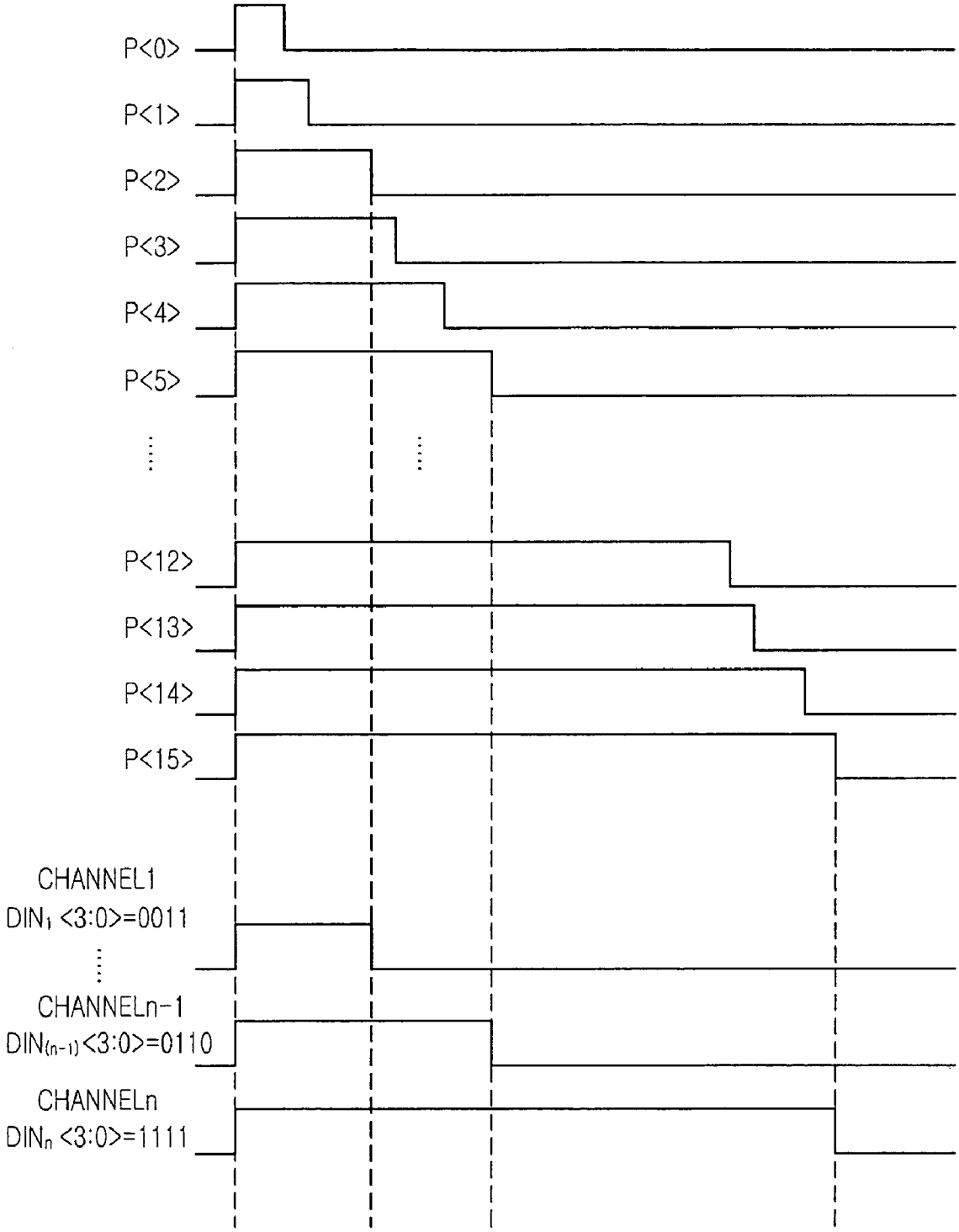
FIG. 2 (PRIOR ART)
FIG. 2 shows waveforms describing the plurality of gray scale pulses and an operation of the PWM selector shown in FIG. 1.
Figure 3:
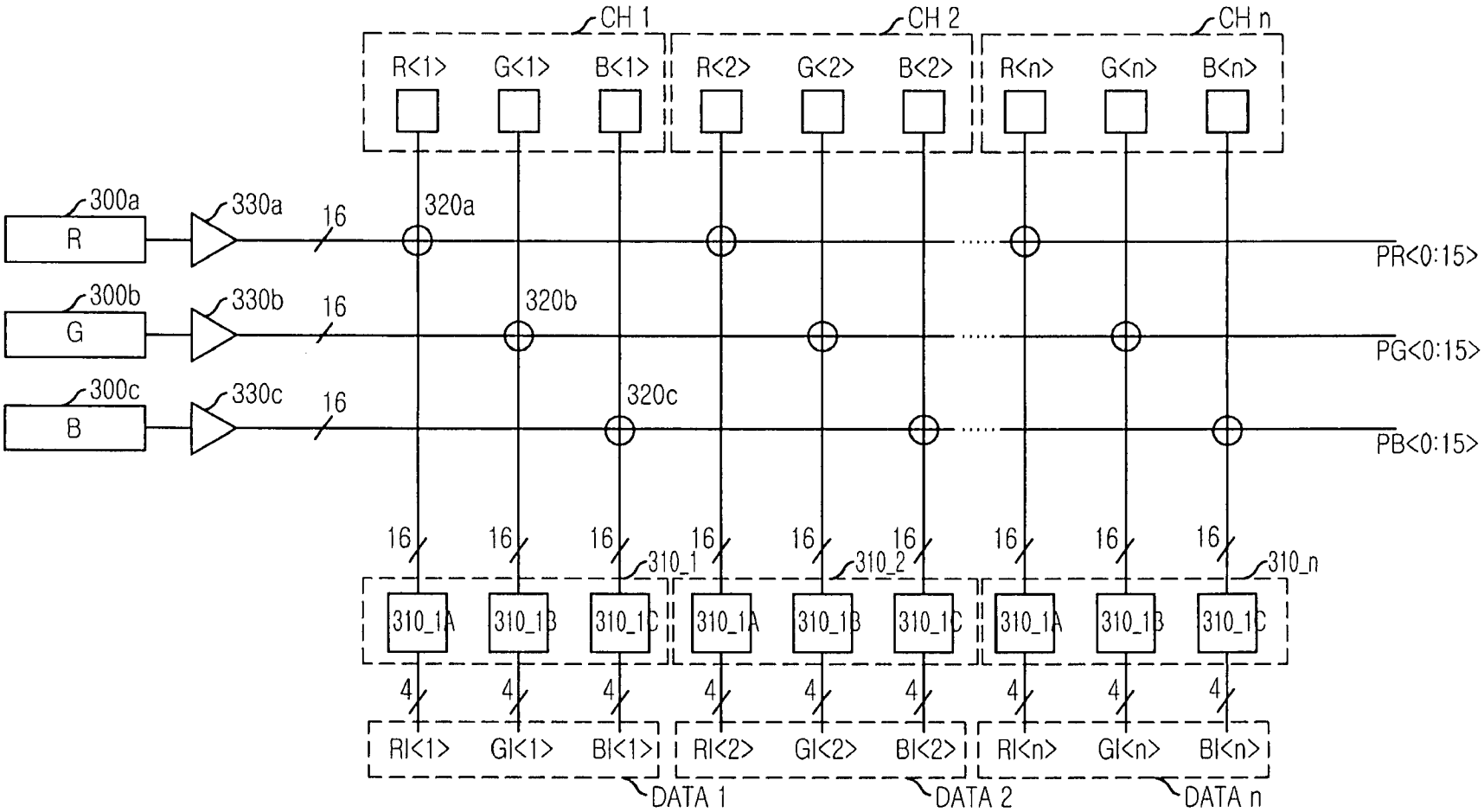
FIG. 3 (PRIOR ART)
FIG. 3 is a block diagram depicting a conventional RGB interface applied with a PWM selector using the PWM method.
Figure 4:
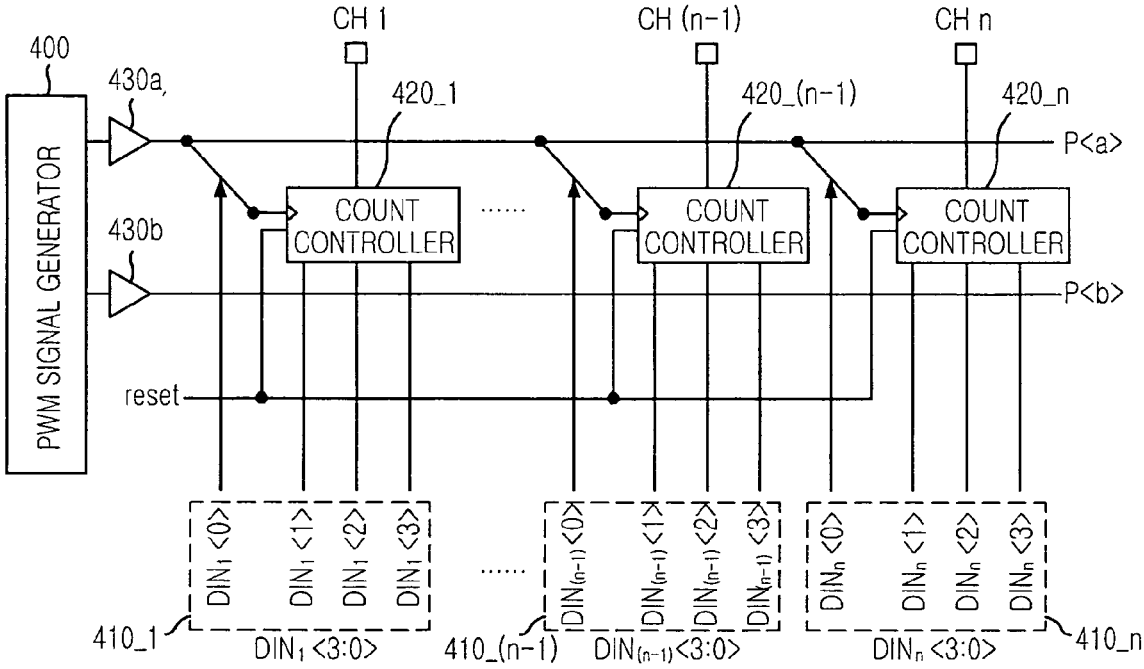
FIG. 4 is a block diagram of a driver using the PWM method for adjusting a gray scale of an image in accordance with an embodiment of the present invention.

FIG. 4 is a block diagram of a driver using the PWM method for adjusting a gray scale of an image in accordance with the present invention.

As shown, the driver is provided with a PWM signal generator 400, first and second buffers 430*a* and 430*b* and a plurality of counter controllers 420_1 to 420_n.

The PWM signal generator 400 generates first and second gray scale pulses P<a> and P<b>, wherein the first gray scale pulse P<a> is complementary with the second gray scale pulse P<b>. Also, the first gray scale pulse P<a> is a signal resulting from the logical XOR operation of a plurality of PWM gray scale pulses. Herein, the number of PWM gray scale pulses is based on the bit number of an image data code. If the bit number of an image data code is K, the number of PWM gray scale pulses is $2^K$. As a result, if the number of PWM gray scale pulses is $2^K$, the number of rising and falling edges in the first gray scale pulse P<a> is $2^K$.

The first and second buffers 430*a* and 430*b* deliver the first and second gray scale pulses P<a> and P<b> to the plurality of count controllers 420_1 to 420_n. Herein, the number of count controllers is based on the number of channels, i.e., the number of pixel columns in the display.

The count controller selects a rising edge of the first or second gray scale pulse P<a> and P<b> in response to the image data code and outputs a gray scale pulse which has a pulse width from an initial point to the selected rising edge to the channel.

Herein, in FIG. 4, the image data code is 4-bit, i.e., K is 4; however, the driver using the PWM method can be applied in the case when the bit number of the image data code is K', i.e., another positive integer.

Figure 5:
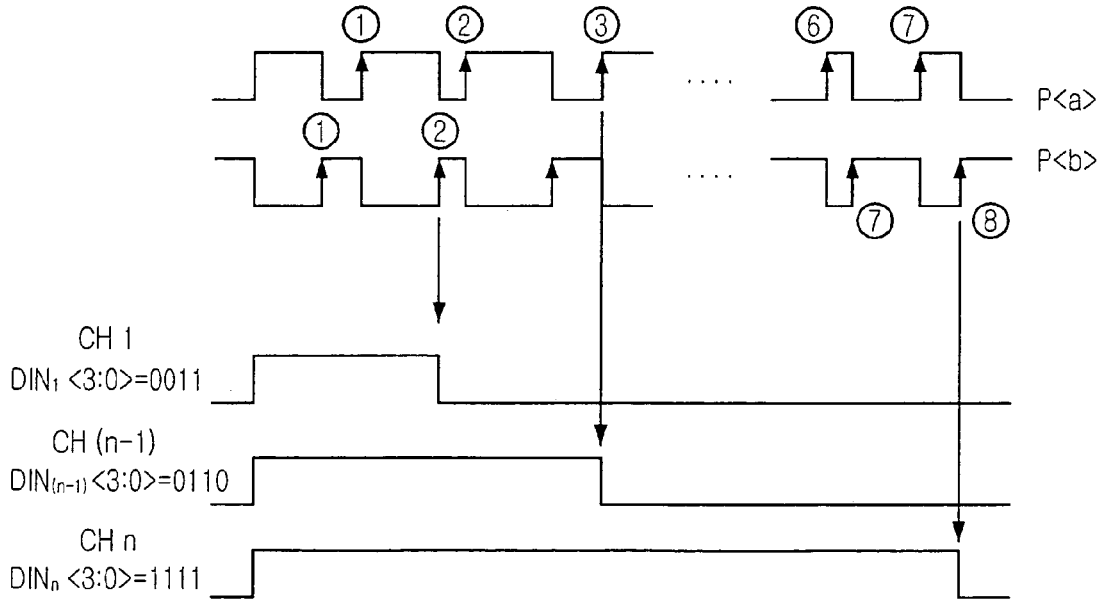
FIG. 5 shows waveforms describing an operation of the count counter shown in FIG. 4.

FIG. 5 shows waveforms describing an operation of the count counter in accordance with an embodiment of the present invention.

As shown, because of the complementary first and second gray scale pulses P<a> and P<b>, the count controller, e.g., 420_1 counts a rising edge of the first gray scale pulse P<a> if the last bit, e.g., $DIN_1$<0> of the image data code is. "1". Otherwise, the count controller, e.g., 420_1 counts a rising edge of the second gray scale pulse P<b> if the last bit, e.g., $DIN_{(n-l)}$<0> of the image data code is "0". Namely, a least significant bit (LSB) of the image data code determines which of the gray scale pulses is counted by the count controller. Herein, the LSB is the last bit of the image data code.

In detail, if a first image data code $DIN_1$<3:0> is inputted as "0011", its LSB is "1". As a result, a first count controller 420_1 counts a second rising edge ② of the second gray scale pulse P<b>. Then, the first count controller 420_1 outputs a first gray scale pulse which has a pulse width from an initial point to the second rising edge ② of the second gray scale pulse P<b> to a first channel CH1.

In the case where a $(n-1)^{th}$ image data code $DIN_{(n-1)}$<3:0> is inputted as "0110", its LSB is "0". As a result, a $(n-1)^{th}$ count controller 420_(n−1) counts a third rising edge ③ of the first gray scale pulse P<b>. Then, the $(n-1)^{th}$ count controller 420_(n−1) outputs a $(n-1)^{th}$ gray scale pulse which has a pulse width from an initial point to the third rising edge ③ of the first gray scale pulse P<a> to a $(n-1)^{th}$ channel CH(n−1).

In the case of an $n^{th}$ image data code $DIN_n$<3:0> inputted as "1111", an nth gray scale pulse is determined by $n^{th}$ count controller 420_n operating in a similar manner of above first count controller 420_1.

As described above, a display apparatus using the PWM method for adjusting a gray scale of an image in accordance with the present invention needs only two gray scale pulses, e.g., P<a> and P<b>, not a plurality of gray scale pulses in response to the bit number of the image data code. If the display apparatus uses a 4-bit image data code, there should be $2^4$, i.e., 16 gray scale pulses. However, in the present invention, there are only two gray scale pulses.

In addition, for determining a gray scale pulse, the count controller can count not only a rising edge of the two gray scale pulses but also a falling edge of the two gray scale pulses. Moreover, if there is one gray scale pulse outputted from a PWM signal generator, the count controller can count the rising and falling edges of the gray scale pulse.

Figure 6:
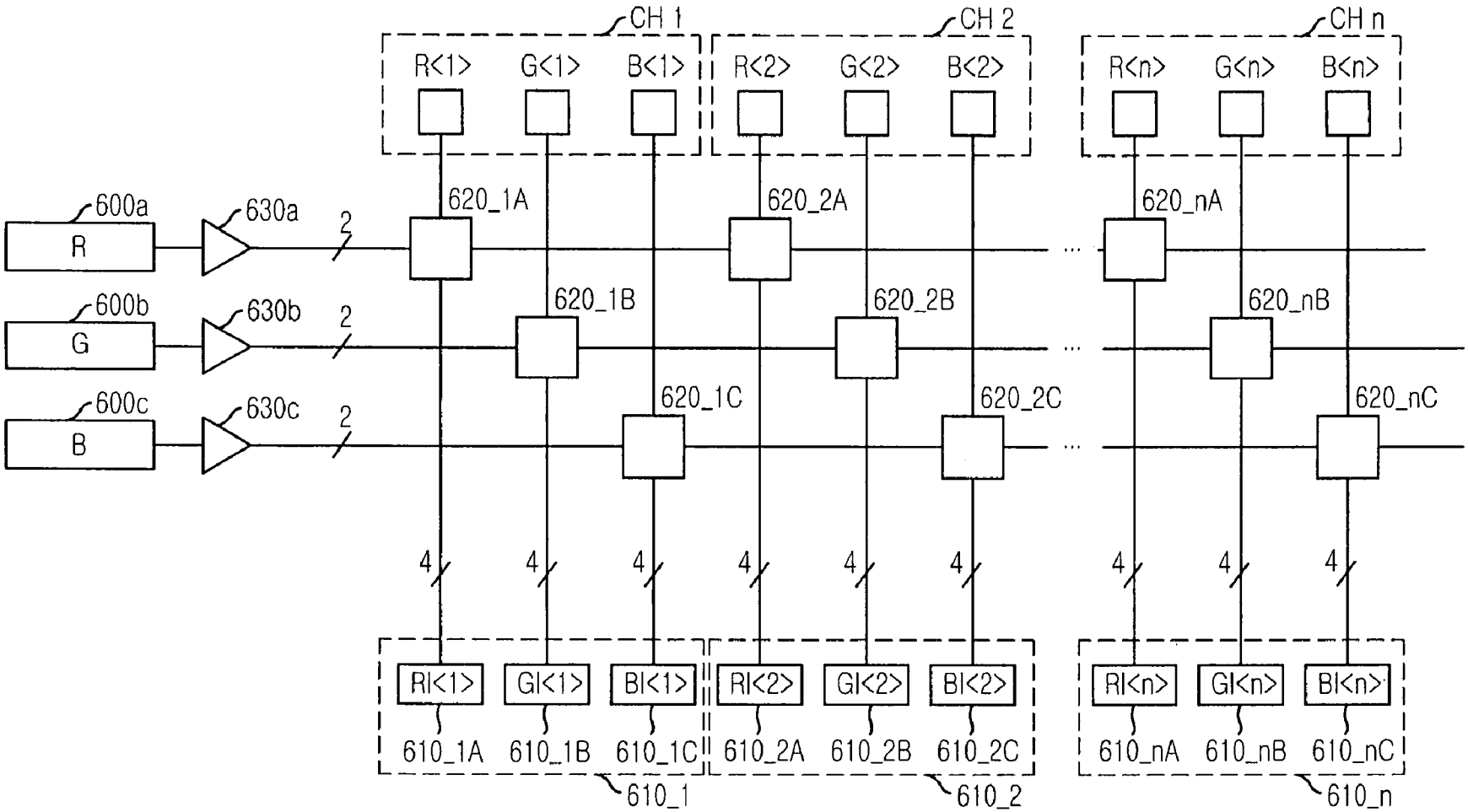
FIG. 6 is a block diagram depicting an RGB interface applied with the driver using the PWM method in accordance with the present invention.

FIG. 6 is a block diagram depicting an RGB interface applied with the driver using the PWM method in accordance with the present invention.

As shown, in the driver, there are a plurality of PMW color signal generators 600*a* to 600*c*, a plurality of 2-bit buffers 630*a* to 630*c* and a plurality of unit count controllers 620_1A to 620_1C, . . . , 620_nA to 620*n*C. Herein, the number of PMW signal generators or buffers is based on the number of colors provided to each channel for reproducing the inputted image. Generally, three colors R, G and B are used. Also, the number of count controllers is based on the number of channels, i.e., the number of pixel columns in the display apparatus.

The plurality of PWM color signal generators 600*a* to 600*c* outputs two color gray scale pulses respectively. One of the two color gray scale pulses is complementary with the other. Also, each color gray scale pulse is a signal resulted from the logical XOR operation of a plurality of PWM gray scale pulses. Herein, the number of PWM gray scale pulses is based on the bit number of an image data code. As a result, each color gray scale pulse has the number of rising and falling edge in response to the bit number of the image data code. Each color gray scale pulse is transmitted through each 2-bit buffer, e.g., 630*a*. In addition, each color data, e.g., RI<1> of each image data, e.g., 610_1 is 4-bit.

Each channel corresponds to each pixel column in the display apparatus. Also, each channel, e.g., CH1 includes three color sub-channels, R<1>, G<1> and B<1>.

Herein, since an operation of each unit count controller, e.g., 620_1A is the same to that of the count controller, e.g., 420_1 shown in FIG. 4, there is omitted a description of the operation of each unit count controller.

As described above, in the RGB interface applied with the driver using the PWM method in accordance with the present invention, each PWM color signal generator outputs each complementary color gray scale pulse to each unit count controller. As a result, the RGB interface can prevent an increase of the number of PWM gray scale pulses corresponding to increasing the bit number of an image data code.

Therefore, though the higher quality image is reproduced, i.e., the more bits of the image data code are needed, the number of wires can be reduced in the present invention. As a result, it is enhanced to integrate the display apparatus using the PWM method, and current consumption is rapidly reduced by decreasing the number of wires.

While the present invention has been described with respect to the particular embodiments, it will be apparent to those skilled in the art that various changes and modifications may be made without departing from the spirit and scope of the invention as defined in the following claims.

What is claimed is:

1. A multi-gradation display apparatus using a pulse width modulation (PWM) method, comprising:

a plurality of channels;

a plurality of input means for outputting a plurality of N-bit image codes in response to a gray scale of an image, wherein N is a positive integer;

a pulse width modulation generator for outputting first and second gray scale pulses, each having $2_N$ edges in response to the bit number of N-bit image codes; and a plurality of count controllers, each selecting an edge of the first or second gray scale pulse in response to the N-bit image code to output a driving pulse having a pulse width from an initial point to the edge of the first or second gray scale pulse to the plurality of channels, wherein the second gray scale pulse is complementary with the first gray scale pulse.

2. The multi-gradation display apparatus as recited in claim 1, wherein the number of channels corresponds to the number of pixel columns included in the multi-gradation display apparatus.

3. The multi-gradation display apparatus as recited in claim 1, wherein the count controller checks and counts only rising edges of the first and second gray scale pulses in order to select the rising edge in response to the N-bit image code.

4. The multi-gradation display apparatus as recited in claim 1, wherein the count controller checks and counts only falling edges of the first and second gray scale pulses in order to select the falling edge in response to the N-bit image code.

5. A multi-gradation display apparatus using a pulse width modulation (PWM) method, comprising:

a plurality of channels;

a plurality of input means for outputting a plurality of N-bit image codes in response to a gray scale of an image, wherein N is a positive integer;

a pulse width modulation generator for outputting a gray scale pulse having $2_N$ edges in response to the bit number of N-bit image code; and a plurality of count controllers, each selecting an edge of the gray scale pulse in response to the N-bit image code to output a driving pulse having a pulse width from an initial point to the edge of the first or second gray scale pulse to the plurality of channels.

6. The multi-gradation display apparatus as recited in claim 5, wherein the count controller checks and counts rising and falling edges of the gray scale pulses in order to select the falling edge in response to the N-bit image code.

* * * * *